United States Patent [19]

Mitsumori

[11] Patent Number: 4,511,364

[45] Date of Patent: Apr. 16, 1985

[54] MIXED FUELS

[75] Inventor: Masaru Mitsumori, Miyazaki, Japan

[73] Assignee: Asahi Kasei Kogyo Kabushiki Kaisha, Osaka, Japan

[21] Appl. No.: 383,922

[22] Filed: Jun. 1, 1982

[30] Foreign Application Priority Data

May 29, 1981 [JP] Japan ..... 56-80827
Jul. 10, 1981 [JP] Japan ..... 56-106857

[51] Int. Cl.[3] ..... C10L 1/32

[52] U.S. Cl. ..... 44/51; 44/55; 44/62; 252/352; 406/49

[58] Field of Search ..... 44/51, 55, 62; 406/49; 252/352; 536/60, 57

[56] References Cited

U.S. PATENT DOCUMENTS 2,265,914 12/1941 Lilienfeld ..... 536/60
2,927,849 5/1960 Greblick et al. ..... 44/51
3,914,130 10/1975 Newcomer ..... 536/60
4,153,421 5/1979 Marlin ..... 44/51
4,156,594 5/1979 Tarpley, Jr. ..... 44/51
4,177,039 12/1979 Sakuma et al. ..... 44/51
4,195,975 4/1980 Hamuro et al. ..... 252/356
4,358,292 11/1982 Battista ..... 44/51

FOREIGN PATENT DOCUMENTS 0050203 8/1978 Japan .

*Primary Examiner*—William R. Dixon, Jr.
*Assistant Examiner*—Margaret B. Medley
*Attorney, Agent, or Firm*—Sughrue, Mion, Zinn, Macpeak and Seas

[57] ABSTRACT

A mixed fuel comprising powdered coal, oil, water, and a dispersion stabilizer is described. The dispersion stabilizer is comprised of water-insoluble fine particles having a colloid-forming ability. More specifically, the stabilizer is comprised of (1) a water-insoluble natural polymeric compound, (2) a water-insoluble polymeric compound prepared by a chemical treatment or dissolution and regeneration of a natural polymeric compound, (3) a water-insoluble synthetic polymeric compound, or (4) a water-insoluble inorganic hydroxide or oxide, or graphite. This mixed fuel has good fluidity and storage stability.

17 Claims, 1 Drawing Figure

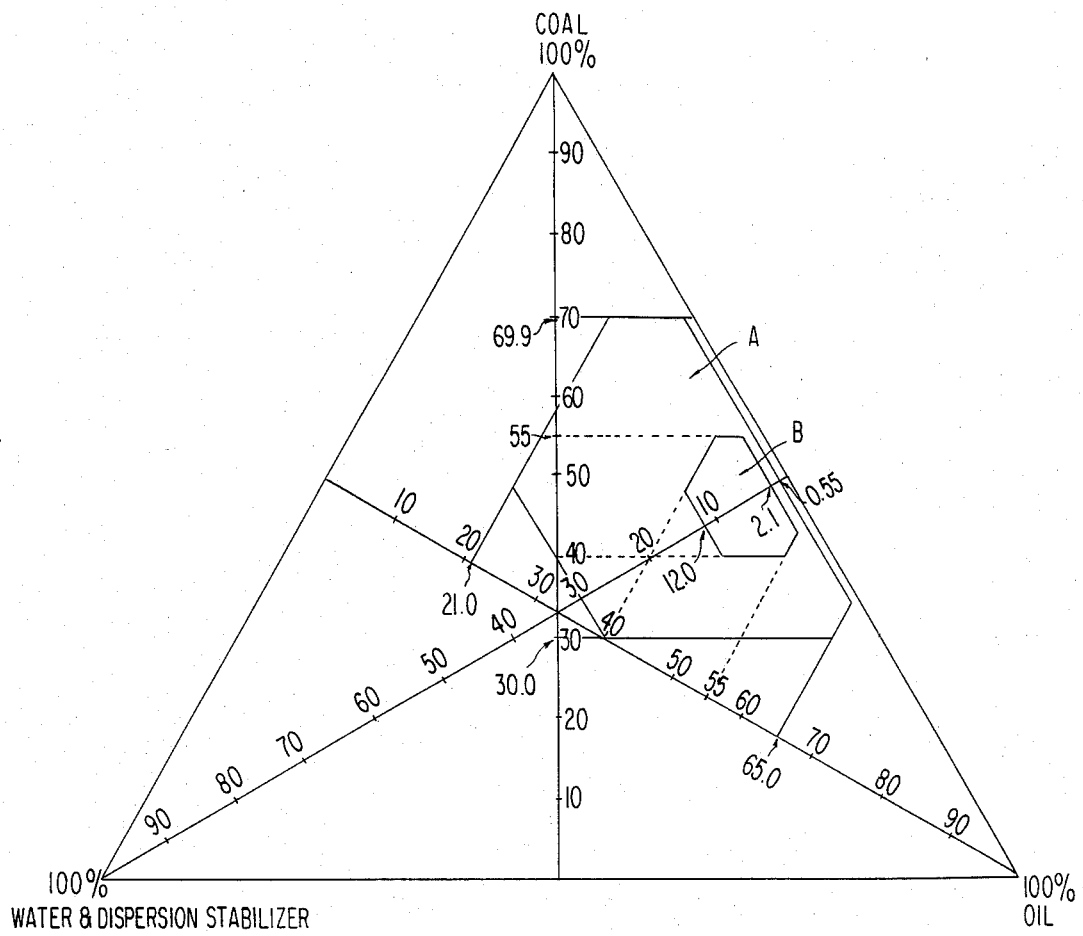
COAL
100%
90
80
70
69.9
60
55
50
40
30
20
10
A
B
10
20
21.0
30
40
50
60
70
80
90
30.0
20
12.0
2.1
0.55
50
55
60
70
80
90
65.0
100%
WATER & DISPERSION STABILIZER
100%
OIL

MIXED FUELS

FIELD OF THE INVENTION

The present invention relates to mixed fuels comprising coal, oil, water and a dispersion stabilizer, more particularly to mixed fuels comprising powdered coal, oil, water and, as a dispersion stabilizer, a water-insoluble fine particle having a colloid-forming ability, which have excellent stability and fluidity.

BACKGROUND OF THE INVENTION

Coal has heretofore been used mainly in a powdered form for the commercial generation of heat energy. Such powdered coal, however, suffers from various problems; for example, it is difficult to transport, its combustion is difficult to control, its calorific value is low, it needs a large space for storage, and there is a danger of spontaneous ignition. In place of coal, therefore, heavy oil has been increasingly used as an energy source.

In recent years, however, in view of problems such as exhaustion of fuel oil and a steep rise in its price, coal has again received increasing attention.

Various attempts to overcome the above-described problems of coal by mixing it with oil were made before World War II as described in, for example, German Pat. Nos. 637,437 and 638,662 (1936). However, when common powdered coal is merely mixed with oil, coal particles will precipitate, forming a solid phase having no fluidity due to the difference in specific gravity between coal and oil. Therefore, it is difficult to store the mixture in a stabilized condition over a long period of time.

In order to improve the storage stability and fluidity of mixed fuel comprising powdered coal and oil, an attempt has been made to further reduce the size of powdered coal particles, so that part of the powered coal particles are capable of forming a colloid (see Japanese Patent Application (OPI) No. 40808/79 (the term "OPI" as used herein means a "published unexamined Japanese patent application")). It has also been proposed that such a super-finely powdered coal is not mixed with oil but suspended in water, and the resulting powdered coal-water slurry is transported and burned (see published unexamined PCT Patent Application in Japan No. 501568/81).

Production, however, of such powdered coal in a super-finely powdered form capable of forming a colloid requires a large quantity of energy and an expensive complicated apparatus for pulverizing the coal. Furthermore, there is a substantial danger of so-called dust explosion when producing such super-finely powdered coal before mixing it with oil or water. In view of such practical problems, the methods have not yet been performed on a commercial scale.

Studies to produce stabilized mixed fuels by mixing common powdered coal with oil as such, i.e., without super-finely pulverizing coal, have been made. Various mixed fuels have thus been proposed wherein water and a dispersion stabilizer are incorporated into such a mixed system of powdered coal and oil to form a network structure of oil/dispersion stabilizer/water/dispersion stabilizer/powdered coal.

Dispersion stabilizers proposed for use in the formation of such network structures are, as can be anticipated by the stabilization mechanism based on the network structure, water-soluble organic compounds and organic polymer compounds which have surface activity or thickening properties. Examples of such compounds include anionic surface active agents, e.g., alkylbenzenesulfonic acid salts and mono- or poly-carboxylic acid salts (Japanese Patent Application (OPI) Nos. 82809/78, 82811/78, etc.), amine-based cationic surface active agents, e.g., mono- or di-alkyl quaternary ammonium salts, mono- or poly-amines and their derivatives, and amines containing an amido bond or an ether bond (Japanese Patent Application (OPI) Nos. 82810/78, 82807/78, etc.), nonionic surface active agents, e.g., polyethers or polyetherpolyols having molecular weights of from 1,000 to 100,000, derived from ethylene oxide, propylene oxide, or the like, and their cross-linked derivatives (Japanese Patent Application (OPI) Nos. 52105/79, 53105/79, 52106/79, etc.), and water-soluble polymeric compounds, e.g., carboxymethyl cellulose, carboxyethyl cellulose, carboxymethyl starch, methyl cellulose, ethyl cellulose, hydroxyethyl cellulose, polyethylene glycol cellulose ether, cellulose acetate, and natural gums, e.g., as guar gum, locustbean gum and alginic acid (Japanese Patent Application (OPI) No. 50203/78).

These dispersion stabilizers, however, are water-soluble organic compounds or organic polymeric compounds, or compounds derived from natural polymeric compounds. Therefore, it is necessary to add them in high proportions. For example, in the mixed fuel of powdered coal and heavy oil C (defined by Japanese Industrial Standard (JIS) K2205 (1958); heavy oil having flash point of at least 70° C., viscosity $\eta_{50°}$ C. of 150 cps or less and pour point of 15° C. or less) which is most inexpensive among fuel oils and is widely used, the amount of the dispersion stabilizer added is as high as about 1%. In order to reduce the amount of the dispersion stabilizer to from 0.1 to 0.3%, it is necessary to decrease the ratio of powdered coal to oil to less than 1/1, or alternatively, to increase the amount of water added to from 2 to 20%. This is disadvantageous from an economic standpoint and, further, gives rise to the problem that polymeric ones of the water-soluble dispersion stabilizers seriously increase the viscosity of the system.

SUMMARY OF THE INVENTION

As a result of extensive investigations to develop dispersion stabilizers which are free from the above-described problems the present invention was developed. It has been found that when water-insoluble fine solid particles having a colloid-forming ability (except for super-finely powdered coal particles) are used as a dispersion stabilizer in the mixed fuel comprising coal, oil, water and a dispersion stabilizer, the resulting mixtures have good fluidity suitable for mass-transportation in tankers and pipe lines, and good stability during storage in large-sized tanks for a long period of time.

The present invention, therefore, relates to mixed fuels comprising coal, oil, water and a dispersion stabilizer wherein the dispersion stabilizer is water-insoluble fine solid particles having a colloid-forming ability.

BRIEF DESCRIPTION OF THE DRAWING

The FIGURE is a triangular diagram illustrating the proportions of powdered coal, oil, and water and a dispersion stabilizer in the mixed fuel of the invention.

DETAILED DESCRIPTION OF THE INVENTION

The term "water-insoluble fine solid particles having a colloid-forming ability" as used herein is specified as follows:

It is now generally accepted that the term "colloid" is used not to distinguish substances, but to indicate a certain state of a substance, i.e., a substance in a special dispersion state or its dispersion state. For particles to be in a relatively stable dispersion state, it is generally necessary for the particles to have diameters falling within the range of from about 0.1 to about 0.001 μm. This range is called a dimension of colloid or a region of colloid. Furthermore, particle colloids can be classified into eight groups depending on whether the dispersant and the dispersing medium are solid, liquid, or gas. According to this classification, the colloid as used herein belongs to the group generally called "sol" in which the dispersant is solid and the dispersing medium is liquid. More specifically, in accordance with the present invention, the primary dispersing medium is water, as can be seen from a method of preparation of the present mixed fuels as described hereinafter, and the dispersants are solid particles which are insoluble, only sparingly soluble, or slightly swell in water or oils such as heavy oil maintained at about 100° C. or lower.

Therefore, in principle, there are many fine particles which fall within the above definition but are not included within the scope of the invention. The reason for this is that of fine particles falling within the above definition, only limited ones can be produced by common and relatively inexpensive techniques. The water-insoluble fine solid particles having a colloid-forming ability which are used in the invention are those particles which are completely insoluble, or very sparingly soluble, or slightly swell in water or fuel oils such as heavy oil and which can be produced as fine particles falling within the region of colloid by conventional inexpensive pulverization and dispersion techniques.

In the mixed fuels of the invention, fine particles having a colloid-forming ability are used as diffusion stabilizers. The particles are comprised of at least one member selected from the group consisting of: (1) water insoluble natural polymeric compounds, (2) water-insoluble polymeric compounds prepared by chemical-treatment, or dissolution and reproduction of natural polymeric compounds, (3) water-insoluble synthetic polymeric compounds, and (4) water-insoluble inorganic hydroxides or oxides and graphite. Of these, the type (2) are preferably used.

It has not previously been expected that such water-insoluble fine particles having a colloid-forming ability would make it possible to form a stable dispersion and suspension of common powdered coal in oil. Among the references as described hereinbefore, the use of water-insoluble fine particles is disclosed only in Japanese patent application (OPI) No. 40808/79 in which coal per se is super-finely pulverized. In this case, although all the coal contained in the mixed fuel need not be in the form of super-fine particles, it is necessary for the super-fine particles to constitute about from 0.5 to 17% by weight of the coal component which is from 40 to 60% by weight of the total mixed fuel. Especially where the coal component constitutes about 50% of the mixed fuel, it is necessary that a 9 to 17% by weight portion of the coal component is in the form of super-fine particles. In view of the above-described proportions and the fact that super-fine particles are coal per se, it is apparent that the water-insoluble fine particles having a colloid-forming ability as used herein are different from those disclosed in the above reference.

In the mixed fuels of the invention, the amount of the dispersion stabilizer added may be as low as from 0.05 to 10% by weight, preferably from 0.1 to 2.0% by weight, based on the total weight of the mixed fuel. This is one of the major features of the invention. It is astonishing that cellulose per se whose effect as a dispersion stabilizer is positively denied in Japanese Patent Application (OPI) No. 50203/78 is included as one of the most effective diffusion stabilizers of the invention.

The above-described effect of the invention which has not been anticipate by conventional techniques is believed to be ascribable to the fact that the dispersion stabilizers of the invention are insoluble in water and are fine to the extent that they per se are capable of forming colloids although the mechanism is not clear. In view of the fact that the presence of water is essential in the invention, it is assumed that the water and dispersion stabilizer combine together to form a colloid dispersion which in turn combines with oil to form an emulsion-like network structure, and that fine coal particles are suspended and held in the network structure.

Further investigations on the dispersion-stabilization effect of various fine particles other than fine particles of cellulose have revealed that almost all of water-insoluble substances which can be pulverized to such fine particles capable of forming a colloid suspension can be effectively used as dispersion stabilizers for use in the invention. It is therefore necessary for the dispersion stabilizers used in the invention to be capable of being formed into fine particles that can form a colloidal suspension, and their dispersion-stabilization effect is not materially affected by properties such as hydrophilic properties and lipophilic properties.

In the case of water-soluble surface active agents and water-soluble polymeric compounds as described hereinbefore, it is necessary to select suitable compounds as dispersion stabilizers depending upon the types of oil and coal and the storage temperature as determined by the type of oil or coal and its properties. With respect to dispersion stabilizers of the invention, it should be noted that one kind of stabilizer can be applied to a wide variety of mixed fuels. This is one of the major advantages of the invention.

Another advantage of the invention resulting from the use of water-insoluble dispersion stabilizers in the form of fine particles is that the mixed fuels of the invention have thixotropic properties. This is different from the stabilization effect based on the thickening action of the prior art techniques.

The term "thixotrophy" is used herein to describe the phenomenon that when a colloidal suspension is caused to flow by application of stress, the viscosity of the suspension is greatly reduced, and when the flow is stopped, the viscosity is recovered to the original level. It is a major advantage in practical use that the mixed fuels of the invention have such thixotrophy, because they are very advantageous in transportation in pipe lines and injection from a nozzle for combustion thereof.

Another advantage of the invention is that many of the dispersion stabilizers for use in the invention are easily available and relatively inexpensive. Furthermore, they can be formed into fine particles by easy and very safe techniques. Especially where natural, semisynthetic or synthetic polymeric compounds are in forms except for latex (e.g., in the form of fiber or fiber-forming resin), they can be chemically pulverized into colloidal fine particles by hydrolysis under conditions suitable for each material. This can be done by a simple, inexpensive and safe technique. Of course, such chemical pulverization can be performed in combination with mechanical grinding as an auxiliary pulverization means. This makes it possible to produce more effective colloidal fine particles.

Means which can be used in such mechanical grinding include a planetary mixer, various types of homogenizers, and a twin-screw kneader (e.g., Readco Continuous Processer® manufactured by Teledyne Readco Co. (USA)). When such mechanical grinding is applied to a wet cake (water content: 20 to 80% by weight) of water-insoluble polymeric compound fine particles which has been prepared by chemical pulverization, colloidal fine particles having fine grain sizes can be easily produced. By employing either chemical pulverization or mechanical grinding singly, colloidal fine particles can be produced. In practical use, however, various factors such as time, energy, and yield are taken into account in determining whether they are employed singly or in combination with each other.

For example, when natural celluloses exemplified by cellulose, e.g., wood pulp, cotton, and flax, and polypeptides, e.g., silk and wool, which are fibrous substances or substances capable of forming fibers, are used for the water-insoluble polymeric substances having a colloid-forming ability and are pulverized directly into colloidal fine particles, they are first chemically pulverized by hydrolyzing in a mineral acid, especially diluted hydrochloric acid, at a temperature of from 100° to 180° C. for a period of from several minutes to several hours. Thereafter, the water is removed by filtration to obtain a wet cake. The wet cake thus obtained is then ground by mechanical means to produce good colloidal fine particles.

On the other hand, when regenerated fibers such as so-called alkali cellulose, prepared by treating the above-described natural cellulose, e.g., cellulose, in an alkali to swell the strong bond between its molecular chains, and so-called viscose rayon and cupra which are prepared by dissolution and reproduction of cellulose are used, fine particles in a sufficiently colloidal form can be produced by only chemical pulverization which is achieved by hydrolysis under suitable conditions. Production is carried out without the application of mechanical grinding which is employed as an auxiliary means for natural celluloses.

Polyamides such as nylon-6- and nylon-6,6, and polyesters such as polyethylene terephthalate are typical examples of synthetic resins having a fiber-forming ability. These polyamides can be relatively easily pulverized into colloidal fine particles by chemical pulverization alone. In the case of polyamides and polyesters, it is advantageous to employ decomposition using alkalis or peroxides.

The mean grain diameter of the above-described fine particles pulverized in a colloidal form is substantially 20 μm or less, preferably from 0.005 to 10 μm, more preferably from 0.01 to 5 μm and most preferably from 0.05 to 2 μm. Particles having mean grain diameters exceeding 20 μm cannot stably suspend the powdered coal. Particles having mean grain diameters less than 0.005 μm cannot normally be obtained by common pulverization techniques. In view of stability and economic factors which should be taken into account in the production of fine particles, fine particles having a mean grain diameter of from 0.05 to 2 μm are most preferred.

In the invention, the size of fine particles of dispersion stabilizer and powdered coal is expressed in a mean grain diameter regardless of their shapes. This mean grain diameter is a Stokes' diameter which is the diameter of a ball corresponding to the fine particle. The Stokes' diameter is defined as the diameter of a ball having the same density as the true density of the fine particles, falling at the same speed as that of fine particles falling in a fluid according to Stokes' law.

In many cases, it is not preferred to dry these fine particles prior to the preparation of mixed fuels for the purpose of economical transportation or storage. The reason for this is that the dispersion-stabilization effect of water-insoluble fine particles of the invention is based on the fact that they are within the so-called region of colloid, i.e., their mean grain diameters within the above described range. When colloidal fine particles falling within the region of colloid are dried to remove the water, they will combine together firmly with each other, forming secondary particles having a mean grain diameter of several ten micro-meters (μm). These secondary particles do not normally return to the original colloidal state even if they are merely dispersed in water. Therefore, it is necessary to apply further chemical pulverization and/or mechanical grinding.

The formation of such secondary particles can be prevented by the application of special techniques, e.g., by sufficiently coating the surface of fine particles with, e.g., a water-soluble polymeric compound. When this is done, even though the fine particles coated with the water-soluble polymeric compound are formed into secondary particles having a large mean grain diameter of several ten micro-meters when they are dried, they can be converted into the original primary particles by stirring by relatively easy mechanical means.

In addition to water-insoluble colloidal fine particles which are produced by chemical pulverization and/or mechanical grinding, a group of natural or synthetic latexes with solid fine particles as dispersants, and a group of water-insoluble inorganic hydroxides and oxides having a colloid-forming ability, or colloidal graphite can be used as dispersion stabilizers in the invention. These compounds are already in a colloid state as in the case of latexes, or are neither organic compounds nor polymeric compounds as in the case of inorganic hydroxides or oxides, and colloidal graphite, which are completely different from the usual surface active agents. Furthermore, they are not similar to water-insoluble colloidal fine particles which are prepared by chemical pulverization and/or mechanical grinding of the above-described natural cellulose, polymeric compounds prepared by chemical treatment or dissolution and regeneration of such natural cellulose or synthetic polymers. However, they can bring about almost the same effect described above. This is based on the fact that they can be converted into water-insoluble fine particles having a colloid-forming ability, or they are already in the form of such fine particles.

Examples of such latexes include latexes of alkyl cellulose ethers, e.g., methyl cellulose, ethyl cellulose and propyl cellulose, having a solids content of from 5 to 50% by weight, natural rubber latexes, synthetic rubber latexes, e.g., styrene-butadiene latex, vinylidene chloride latex, acryl latex and vinyl acetate latex, with ethyl cellulose latex and natural rubber latexes being preferred.

These latexes are commercially available as film-forming materials or paints, and are generally not expensive. Furthermore, since the proportion of such latexes in the mixed fuel is small, they can be commonly used. In these latexes, the resin component, i.e., dispersant, is in colloid dispersion clearly as solid fine particles at ordinary temperature. Therefore, they are clearly distinguishable over liquid-liquid emulsions (oil-in-water or water-in-oil) in which the resin component is dispersed as oil droplets comprising the resin component dissolved in an organic solvent. In accordance with the classification of the invention, such liquid-liquid emulsions are grouped into the scope of the conventional mixed fuels containing surface active agents as dispersion stabilizers. Therefore, they are not preferred in that they suffer from the same disadvantages as described hereinbefore.

Suitable examples of water-insoluble inorganic hydroxides, oxides, and graphite which can be used as water-insoluble fine particles having a colloid-forming ability include super-finely powdered silica, aluminaum hydroxide, ferric hydroxide, and titanium hydroxide (titanic acid). In addition to these compounds, as well-known inorganic colloids, there can be mentioned gold colloid, sulfur colloid, and vanadium pentaoxide fine powder. Gold colloid is not suitable for practical use since it is very expensive. Although sulfur colloid and vanadium pentaoxide fine powder are relatively cheap, when they are burned as a component of mixed fuel, they are discharged and dissipated in the air as substances which are harmful to the human body. Thus, they are not suitable for practical use.

Super-finely powdered silica is a fine particle having a mean grain diameter of about 40 μm or less, preferably from 0.005 to 10 μm, more preferably from 0.01 to 5 μm, and most preferably from 0.05 to 2 μm. This silica is a mixture or compound containing $SiO_2$ in a proportion of at least about 60%. Examples of such super-finely powdered silica are:

(1) Anhydrous silica super-fine particles produced from ferrosilicon, such as "Aerosil" ($SiO_2$ composition produced by Japan Aerosil Co.; mean grain diameter 0.007–0.05 μm; specific surface area 50–380 $m^2/g$; bulk density 60 g/l; and true specific gravity 2.2 g/cc; refractive index 1.45; electric resistance $10\times10^{12}$ Ωcm and thermal conductivity 0.022 kcal/m.h.°C. (0° C.), "Cab-O-Sil" (produced by Cabot Co., etc.);

(2) Colloidal silica which is prepared by adjusting the pH of silica sol with high-speed stirring to precipitate fine particles of silica and, thereafter, by mechanically grinding the resulting wet cake; and (3) Silica gel fine particles having a mean grain diameter of 20 μm or less which are produced by mechanically pulverizing and grinding the usual silica gel. Of the above-described silica, anhydrous silica super-fine particles which are commonly called "white carbon" and are commercially available are most preferred.

Aluminum hydroxide, ferric hydroxide, titanium hydroxide, etc. which are used as water-insoluble inorganic hydroxide having a colloid-forming ability are colloidal gels which are readily prepared by, for example, neutralizing an aqueous solution of chloride of each metal with ammonia water. When using gels, it is not preferred that they are dried for the purpose of reducing the costs associated with transportation or storage thereof. The reason for this is that when these hydroxides are powders by heat-dehydration, they are converted into oxides having a certain water content. This results in the formation of coarse secondary particles which cannot be converted into the original colloidal gel even if they are mechanically ground after the addition of water. Therefore, when using these inorganic hydroxides it is preferred to use them in the preparation of mixed fuel while maintaining them in the state of colloidal gel in which they were originally produced.

Water-insoluble powdered graphite having a colloid-forming ability as used herein is generally called "colloid graphite". This is prepared by mixing common graphite powder with water and grinding it in a ball mill or a colloid mill.

The kind of coal used in the mixed fuel of the invention is not critical, but it is preferable to use common fuel coal which can be pulverized to grain diameters as described hereinafter, e.g., anthracite, bituminous coal, and brown coal. It is, however, disadvantageous from an economic viewpoint to use lignite having a lower degree of carbonization because of its low calorific value per unit weight and a danger of spontaneous ignition during pulverization. Peat having a much lower degree of carbonization is much more disadvantageous from an economic standpoint than lignite and many problems arise in mixing peat with oil for the preparation of mixed fuel due to its too high water content.

Coal is finely pulverized to mean grain diameters which are nearly equal or somewhat smaller than those of powdered coal that is used in usual coal combustion furnaces. That is, the powdered coal which can be used in the invention is pulverized so that all (100%) can pass through a 100-mesh screen, preferably all can pass through a 100-mesh screen and a 60 to 90% portion can pass through a 200-mesh screen. Pulverization of coal to such levels can be easily and safely performed by conventional techniques. Although coal can be much more finely pulverized, it is not economical and such pulverizing is associated with the danger of spontaneous ignition.

Any common fuel oil can be used in the prepartion of the mixed fuels of the invention. From an economic viewpoint, however, it is preferred to use heavy oil, especially one having a pour point of about 50° C. which is generally called heavy oil C, or crude oil. Of course, heavy oil B, heavy oil A, middle oil, light oil, etc. can be used in the invention. However, it is not economical to burn them together with coal as a mixed fuel since they are expensive.

In the preparation of mixed fuels having good stability and fluidity from the above-described coal, oil, a dispersion stabilizer and water, the method of preparation and the proportions of the components are important.

With regard to the method of preparation of mixed fuels, Japanese Patent Application (OPI) No. 16007/78 discloses that the order of addition of components is significant in the preparation of a mixed fuel which contains, as a dispersion stabilizer, polyethylene oxide or polyacrylamide which is a typical water-soluble synthetic polymer. According to the reference, in order to effectively produce a stable mixed fuel the water-soluble synthetic polymer is first dissolved in a small amount of water, powdered coal is then added to the resulting aqueous solution and fully dispersed therein and, thereafter, oil is added to the resulting dispersion.

Similarly, Japanese Patent Application (OPI) No. 50203/78 describes that, in order to obtain good dispersion stability, it is advantageous to mix powdered coal with oil after all or part of the powdered coal is wet with water. It is assumed that when powdered coal is mixed with oil, it is entirely covered with the oil since the surfaces of the powdered coal is relatively lipophilic. Therefore, even if an aqueous solution of dispersion stabilizer is added thereafter, the surface of the powdered coal cannot be covered with the micell of the dispersion stabilizer. Accordingly the function of the dispersion stabilizer cannot be fully exhibited. Thus, it is understandable that the order of addition of the components is important in the preparation of mixed fuels, as proposed in the above references.

While these methods of preparation may be employed in the preparation of the mixed fuels of the invention, good results can also be obtained by a method of preparation as described hereinafter. This suggests that there are great differences between the mechanisms of dispersion-stabilization in the invention and the above references.

In accordance with a preferred method of preparation of the invention, water-insoluble fine particles having a colloid-forming ability are first added to a small amount of water and fully dispersed therein. Dispersion is carried out by means of, e.g., a homogenizer to form a colloidal suspension. The dispersion stabilizer suspension thus formed is then slowly added to an oil which has been heated to about 70° C. while fully stirring the oil. Thereafter, the resulting mixture is well stirred further for a period of from about 15 to 30 minutes to produce a stable emulsion comprising the water, dispersion stabilizer and oil. Finally, to the thus-produced emulsion is slowly added a predetermined amount of powdered coal while fully stirring the emulsion. After the addition the powdered coal is completed, it is dispersed by stirring further for 30 to 60 minutes.

The fact that the above-described method of preparation brings about much better results is believed to support the assumption that the effect of dispersion-stabilization of the invention is achieved by the network structure of water/dispersion stabilizer/oil in which powdered coal is held.

In any event, a method of preparation of mixed fuel in which powdered coal and oil are first mixed and, thereafter, water and a dispersion stabilizer are added is not suitable for use in the invention.

The term "water" as used herein means all the water contained in the mixed fuel system. More specifically it consists materially of the water contained in powdered coal, the water contained in water-insoluble fine particles having a colloid-forming ability which are prepared sometimes in a wet manner by chemical pulverization and/or mechanical grinding, or which are in the form of latex, and water which is added if necessary.

The mixed fuel of the invention comprises from 69.9 to 30.0% by weight, preferably from 40 to 55% by weight of powdered coal, and from 21.0 to 65.0% by weight, preferably from 55 to 40% by weight of oil, with the balance being water and dispersion stabilizer. The water content is from 0.5 to 20% by weight, preferably from 2.0 to 10% by weight. The dispersion stabilizer content is from 0.05 to 10% by weight, preferably from 0.1 to 2.0% by weight. This composition range is represented by the area indicated by A in the triangular diagram of the Figure, with the area B being perferred. When the oil is less than 21.0% by weight, the resulting mixed fuel loses its fluidity due to a large proportion of coal, or oil-water separation takes place due to a large proportion of water even with a large amount of dispersion stabilizer. When the oil is more than 65.0% by weight, the resulting mixed fuel is free from problems concerning its fluidity and stability but has low economical value because of a too small proportion of coal. When powdered coal is added excessively beyond the range as specified above, the stability of the resulting mixed fuel is seriously degraded even with a large amount of dispersion stabilizer. When the water content is too small, the dispersion stability is seriously reduced, whereas when the water content is too large, the calorific value of the mixed fuel is decreased, which is disadvantageous from an economic standpoint and will undesirably cause oil and water separation. When the amount of the dispersion stabilizer added is less than the lower limit as specified hereinbefore, the powdered coal will readily precipitate, which is not desirable for the mixed fuel of the invention. On the other hand, when the amount of the dispersion stabilizer added is too large, the production costs may be undesirably increased although the dispersion stability is increased.

More preferred compositions and dispersion stabilizers are as follows:

Coal: powdered coal which is pulverized so that all (100%) can pass through a 100-mesh screen, of which a 60 to 90% portion can pass through a 200-mesh screen;

Oil: heavy oil C; and

Dispersion stabilizer: wet cake of fine particles having a mean grain diameter of from 0.5 to 1.5 μm, falling within the region of colloid, which is prepared by alkali-treating linter cellulose, washing the linter cellulose thus treated with water to form alkali cellulose and, thereafter by subjecting the alkali cellulose to chemical pulverization by means of hydrolysis using diluted hydrochloric acid.

The powdered coal content is from 40 to 55% by weight and the heavy oil C content is from 55 to 40% by weight, and the total of the two components is from 92.5 to 96.5% by weight. The water content is from 3.0 to 7.0% by weight, and the dispersion stabilizer content is from 0.1 to 2.0% by weight.

In the preparation of a mixed fuel from the above-described components, the amount of water contained in the dispersion stabilier is first measured. Thereafter the amount of wet cake needed is calculated. The wet cake is mixed with a predetermined amount of water and fully dispersed therein by the use of a homogenizer. The dispersion thus formed is pre-heated to about 70° C. and added to a predetermined amount of heavy oil C which is being sufficiently stirred by, e.g., a homomixer, to prepare a water/heavy oil emulsion. A predetermined amount of powdered coal is then added slowly to the emulsion prepared above, and fully dispersed therein by stirring further for about 30 minutes by means of, e.g., a homomixer. Thus, the optimum mixed fuel of the invention is produced.

When the mixed fuel as prepared above was subjected to stability testing by allowing it to stand at 70° C. for about 2 months, this test showed that deposition of powdered coal was nearly eliminated and the viscosity was nearly uniform and, at the same time, was nearly equal to the viscosity at the time when the mixed fuel was prepared. Thus it can be seen that the mixed fuel has excellent stability and viscosity characteristics.

The following examples are given to illustrate the invention in greater detail although the invention is not limited thereto.

In the examples, unless otherwise indicated, the values and percentage (%) in parentheses are by weight (based on the total weight of the mixed fuel), and the viscosity was measured by the use of a Brookfield type viscometer and the value after rotation for 30 seconds at 12 r.p.m. is indicated.

EXAMPLE 1

A fine crystalline cellulose slurry which had been prepared by treating sulfate wood pulp in 1% HCl at 125° C. for about 60 minutes was suction-dehydrated, washed with water, and again dehydrated. Thereafter, it was placed in Continuous Readco Processor (manufactured by Teledyne Readco Co.) and mechanically ground to obtain a fine crystalline cellulose-ground wet cake having a mean grain diameter (Stokes' diameter) of 1.2 μm and a water content of 55% by weight. The average degree of polymerization (DP) of the cellulose was about 180. Then, 8.9 g (4.0 g as calculated as pure fine crystalline cellulose) of the wet cake was added to 33.1 g of water and thoroughly dispersed therein by means of a propeller stirring-type homogenizer (15,000 rpm) to prepare 42.0 g of a colloid dispersion of fine crystalline cellulose.

Heavy oil C ($d_{70}$: 0.92; $\eta_{70}$; 30 cps) in the amount of 178 g was placed in a beaker, heated to 70° C. in a water bath, and stirred by means of a homomixer. Then, 42.0 g of the colloid dispersion of fine crystalline cellulose as prepared above was gradually added to the heavy oil C maintained at 70° C. while stirring and further stirred for 15 minutes to obtain an emulsion comprising heavy oil C, water, and fine crystalline cellulose in the amount of 178 g, 38 g, and 4.0 g, respectively.

Powdered coal (191.4 g) having a water content of 7.0% which had been produced by pulverizing brown coal from Australia by means of a centrifugal grinder in such a manner that 100% passed through 100-mesh, 85% through 200-mesh, and 82% on 400-mesh was gradually added to the emulsion as prepared above at 70° C. over a period of 15 minutes while vigorously stirring by a homomixer. After the addition of the powdered coal was completed, the resulting mixture was further stirred for 30 minutes. At the end of the time, immediately, the viscosity was measured by the use of a rotary viscometer at a rate of 12 rpm. The viscosity $\eta_{70}$, was 1,550 cps, and the apparent specific density, $d_{70}$, was 1.06.

Then, 400 g of the mixed fuel thus produced (powdered coal/heavy oil C/water/fine crystalline cellulose=43.3/43.3/12.5/0.97) was transferred to a cylindrical vessel made of iron having a diameter of 50 mm and a length of 280 mm (this vessel is hereinafter referred to as a "test vessel"). This test vessel was provided with a reflux condenser at the top thereof for the purpose of preventing the evaporation of water, and it was then placed in a silicone oil bath maintained at 70° C. to the depth that the surface of the oil reached near the top of the test vessel and was allowed to stand.

Seven days, 15 days, 30 days, and 45 days after the test vessel was placed in the silicone oil bath, the test vessel was taken out to test the still-standing stability (hereafter merely referred to as "stability") of the mixed fuel. After the reflux condenser was removed, the mixed fuel was decanted to divide into an upper layer portion, an intermediate layer portion and a lower layer portion in amounts of 130 ml, respectively. Each layer portion was placed in a tall beaker, which was placed in a water bath maintained at 70° C. While the tall beaker was placed in a water bath, the viscosity, $\eta_{70}$, was measured in the same manner as described above. A significant difference in the viscosity, $\eta_{70}$, among the upper layer portion, the intermediate layer portion, and the lower layer portion was employed as a measure of the stability.

The results are shown in Table 1. It can be seen from Table 1 that after 7 days and even after 45 days, no significant difference in viscosity among the three layer portions is observed, and that the mixed fuel exhibits a very good stability.

EXAMPLE 2

Crude linter (second cut linter from U.S.A.) was boiled and washed in the usual manner to provide purified linter. This purified linter was treated in 3.6% HCl at 150° C. for about 15 minutes and, thereafter, was suction-dehydrated, washed with water, and again suction-dehydrated to obtain a fine crystalline cellulose wet cake having a mean grain diameter of 5 μm. The water content was 50% by weight. The average degree of polymerization of the fine crystalline cellulose was about 210.

Using the thus-prepared wet cake as a dispersion stabilizer, a mixed fuel comprising powdered coal (brown coal), heavy oil C, water, and fine crystalline cellulose from linter (47.2/47.2/5.0/0.6) was produced in the same manner as in Example 1. The grain size of the powdered coal was almost the same as that in Example 1.

Just after the preparation of the mixed fuel, the viscosity, $\eta_{70}$, was 900 cps, and the specific density, $d_{70}$, was 1.05.

The mixed fuel thus produced was transferred to a test vessel and its stability was examined at 70° C. in the same manner as in Example 1. The results are shown in Table 1.

COMPARATIVE EXAMPLE 1

A mixed fuel was produced in the same manner as in Example 2 except that a surface active agent, decyl 3-aminopropyl ether was used as a dispersion stabilizer. The mixed fuel was subjected to the same stability testing as in Example 2.

Just after the preparation of the mixed fuel, the viscosity, $\eta_{70}$, was 3,000 cps, and the specific density, $d_{70}$, was 1.05. The results are shown in Table 1.

Compared with the results in Example 1, it can be seen that the viscosity of the mixed fuel after the preparation thereof is considerably high, and after about 15 days, deposition of the powdered coal to the lower layer clearly starts. Thus, the dispersion stabilizer of the present invention is essential for the improvement of stability.

COMPARATIVE EXAMPLE 2

This comparative example is performed to demonstrate that it is essential for the mixed fuel of the invention to have a water content of from 0.5 to 20%.

A fine crystalline cellulose wet cake (water content 50% by weight) was produced from linter in the same manner as in Example 2, and it was further dehydrated by the use of filter paper to obtain a wet cake having a water content of 30% by weight.

Then, 2.44 g of the thus produced wet cake having the reduced water content was added to 178 g of heavy oil C which was maintained at 70° C. and vigorously stirred by means of a homomixer. The resulting mixture was stirred for about 30 minutes to disperse fine crystalline cellulose in the heavy oil C. To the dispersion thus produced was gradually added 178 g of the same powdered coal as used in Example 2 except that the water content was reduced to substantially zero by carefully drying. The resulting mixture was further stirred for about 30 minutes to obtain a mixed fuel. The composition of the mixed fuel was powdered coal/heavy oil C/water/fine crystalline cellulose (49.5/49.6/0.26/0.60).

Just after the preparation of the mixed fuel, the viscosity $\eta_{70}$, was 4,500 cps, and the specific density, $d_{70}$, was 1.05. The mixed fuel was subjected to the same stability testing as in Example 2 at 70° C. The results are shown in Table 1. Compared with the results in Example 2, it can be seen that in respect of the viscosity after the preparation of the mixed fuel and the stability, the presence of water within the predetermined range is essential in the mixed fuel of the invention.

COMPARATIVE EXAMPLE 3

This comparative example is performed to demonstrate that drying of wet fine crystalline cellulose will lead to an increase in grain diameter which eliminate the desirable dispersion-stabilization effect.

A wet cake which had been prepared in the same manner as in Example 2 was again suspended in water to make a slurry. The slurry was then dried by a spray drier to obtain dry powder of fine crystalline cellulose having a water content of 5.3%. The dry powder was screened to obtain fine particles having a mean grain diameter of 25 μm.

Using the thus-produced fine particles, a mixed fuel was produced in the same manner as in Example 1 which had the composition as shown in Table 1. The mixed fuel was subjected to the same stability testing as in Example 1. After 15 days, the separation of powdered coal occurred. Accordingly, the desired dispersion-stabilization effect was not obtained.

EXAMPLES 3 TO 10

Various cellulose materials were finely pulverized by appropriately employing a hydrolysis decomposition method and a mechanical grinding method. Using these fine particles as dispersion stabilizers, mixed fuels were produced in the same manner as in Example 1, and they were then subjected to the stability testing. The mean grain diameters of the cellulose fine particles, the compositions of the mixed fuels, and the evaluation results are shown in Table 1.

It can be seen that these cellulose fine particles are preferred dispersion stabilizers.

EXAMPLES 11 TO 16

Natural or synthetic fibrous materials or materials having a fiber-forming ability other than cellulose were finely pulverized mainly by a chemical pulverization method. Using these fine particles as dispersion stabilizers, mixed fuels were produced in the same manner as in Example 1.

The method of pulverization, the mean grain size of fine particles, the composition of the mixed fuel, and the evaluation results are shown in Table 2.

It can be seen that the fine particle greatly contributes to the dispersion-stabilization effect.

EXAMPLES 17 TO 28

Mixed fuels were produced in the same manner as in Example 1 except that colloidal fine particles made of non-fibrous materials or materials not having a fiber-forming ability were used as dispersion stabilizers in the form of latex, sol, or dry super-fine powder. The results are shown in Table 3. In Examples 19 and 21, the viscosity of the mixed fuels increased with the lapse of time while there was no tendency for coal particles to deposit in the lower layer.

The results demonstrate that a common factor, the use of colloidal fine particles, greatly contributes to the dispersion-stabilization effect.

EXAMPLES 29 TO 40 AND COMPARATIVE EXAMPLES 4 TO 8

Alkali cellulose which had been prepared by treating crude linter with alkalis was fully washed with water and hydrolyzed with HCl to produce a wet cake of fine crystalline cellulose. Using the wet cake thus produced as a dispersion stabilizer, mixed fuels were prepared and evaluated in order to demonstrate that the composition of mixed fuel contributed to the stability. The results are shown in Table 4. The method of preparation of the mixed fuels was the same as in Example 1.

It can be seen that the dispersion-stabilization effect of the invention can be obtained when the proportion of each composition is within the range as specified in the invention.

EXAMPLES 41 TO 47 AND COMPARATIVE EXAMPLES 9 AND 10

Mixed fuels were prepared in the same manner as in Example 1 except that fine crystalline celluloses having various mean grain diameters were used as a dispersion stabilizer. The mixed fuels were subjected to the same stability testing as in Example 1 and the results are shown in Table 5.

It can be seen that particle size of the dispersion stabilizer greatly contributes to the dispersion-stabilization effect.

In Table 1 to 5, the following symbols were used.

A: Chemical pulverization by hydrolysis.
- A-1: Hydrolysis in 1% aqueous hydrochloric acid solution at 125° C. for 1 hour
- A-2: Hydrolysis in 3.6% aqueous hydrochloric acid solution at 150° C. for 15 minutes
- A-3: Hydrolysis in 2.0% aqueous sulfuric acid solution at 115° C. for 45 minutes B: Chemical pulverization by oxidative decomposition
Oxidative decomposition in benzene in the presence of a catalytic amount of benzoyl peroxide at 150° to 170° C. and under air pressure.

C: Mechanical grinding
- C-1: Mechanical grinding by means of Continuous Readco Processor (manufactured by Teledyene Readco Co.).
- C-2: Mechanical grinding by means of a planetary mixer
- C-3: Mechanical grinding by means of a waring blender D: Type and grain size of coal
- D-1: Powdered brown coal which is produced so that 100% is through 100-mesh, 85% through 200-mesh, and 82% on 400-mesh.

D-2: Powdered brown coal which is produced so that 100% is through 100-mesh, 65% through 200-mesh, and 0.5% through 400-mesh.

D-3: Powdered bituminous coal which is produced so that 100% is through 100-mesh, 40% through 200-mesh, and 0.2% through 400-mesh.

D-4: Powdered anthracite which is produced so that 100% is through 100-mesh, 88% through 200-mesh, and 4% through 400-mesh E: Type of Oil E-1: Heavy oil C ($d_{70}$: 0.92; $\eta_{70}$: 30 cps)

E-2: Heavy oil B

E-3: Arabian light oil

E-4: Waste oil from gasoline stands, comprising lubricant oil for cars and washing oil E-5: Waste oil from ships (1): The value of evaluation represents the viscosity of a mixed fuel at 70° C., as determined by a Brookfield viscometer after rotation for 30 seconds at 12 rpm. With regard to a mixed fuel exhibiting thixotropic properties, it is divided into an upper layer portion, an intermediate layer portion, and a lower layer portion, and their viscosities are measured separately after stirring. The viscosities of the upper, intermediate and lower layer portion are given in the manner, upper layer portion/intermediate layer portion/-lower layer portion, in the tables.

(2): The deposition of coal is vigorous. The supernatant liquid (upper layer) is composed almost of oil, whereas the lower layer is a solid layer composed of powdered coal. This solid layer cannot be taken out of a test vessel by decantation. This solid layer is so hard that a metallic bar of diameter of 8 mm can not easily pass therethrough, and its viscosity cannot be measured at all.

(3): The criteria for the synthetic evaluation in Tables 1 and 5 and for the evaluation after 30 days in Tables 2 to 4 are as follows:

◎ : There is no sign of oil or water-coal separation's occurring among the upper layer—intermediate layer—lower layer. Furthermore, a collective increases in viscosity with a lapse of time is nearly undetectable. Thus, the mixed fuel exhibits excellent stability.

○: Although there is no sign of such separation's occurring, a slight collective increase in viscosity with a lapse of time is observed.

Δ: The difference in viscosity between the upper layer—intermediate layer—lower layer becomes clear with a lapse of time, but, after 30 days, the lower layer still has fluidity.

X: Deposition of powdered coal clearly occurs. The upper layer is composed almost of oil and is fluid, whereas the intermediate layer is composed of powdered coal and oil in which the powdered coal is rich, and its viscosity is high. The lower layer is like a solid layer composed of powdered coal solidified by oil, is hard, and does not have any fluidity. When a metallic bar 8 mm in diameter is pressed to the solid lower layer, it can pass therethrough although with difficulty.

XX: The upper layer is a supernatant liquid composed materially of oil and has a viscosity of 100 cps. The intermediate and lower layer are very hard due to the deposition of powdered coal and do not have any fluidity. When a metallic bar of diameter of 8 mm is pressed, it can pass through the intermediate layer although with difficulty, but cannot pass through the lower layer at all.

TABLE 1-1

| Example No. | Dispersion Stabilizer (Water-Insoluble Fine Particles having Colloid-Forming Ability) | | | | Composition (wt %) | | | |
|---|---|---|---|---|---|---|---|---|
| | Form of Fine Particle | Mean Grain Diameter | Starting Material for Fine Particles | Fine Pulverization Conditions | Stabilizer | Water | Coal | Oil |
| 1 | wet cake of fine crystalline cellulose | 1.2 μm | sulfate wood pulp | A-1 + C-1 | 0.97 | 12.5 | (D-1) 43.3 | (E-1) 43.3 |
| 2 | wet cake of fine crystalline cellulose | 5.0 μm | purified linter | A-2 | 0.60 | 5.0 | (D-1) 47.2 | (E-1) 47.2 |
| Com. Ex. 1 | decyl 3-aminopropyl ether | — | — | — | 0.60 | 5.0 | (D-1) 47.2 | (E-1) 47.2 |
| Com. Ex. 2 | wet cake of fine crystalline cellulose | 5.0 μm | purified linter | A-2 | 0.60 | 0.26 | (D-1) 49.5 | (E-1) 49.6 |
| Com. Ex. 3 | dry powder of fine crystalline cellulose | 25.0 μm | purified linter | A-2 + drying by spray drier followed by pulverization | 5.0 | 10.0 | (D-1) 42.5 | (E-1) 42.5 |
| 3 | wet cake of fine crystalline cellulose | 0.6 μm | alkali cellulose prepared by alkali treatment of purified linter | A-2 + C-1 | 0.3 | 4.0 | (D-1) 48.5 | (E-1) 47.0 |
| 4 | wet cake of fine crystalline cellulose | 1.0 μm | alkali cellulose prepared by alkali treatment of purified linter | A-1 | 0.5 | 5.0 | (D-2) 47.0 | (E-1) 47.5 |
| 5 | wet cake of fine crystalline cellulose | 17.0 μm | crude linter | A-2 | 3.0 | 7.0 | (D-1) 45.0 | (E-2) 45.0 |
| 6 | wet cake of fine crystalline cellulose | 9.0 μm | sulfate wood pulp | A-3 | 1.0 | 9.0 | (D-1) 47.0 | (E-1) 43.0 |
| 7 | wet cake of fine crystalline cellulose | 19.0 μm | flax purified by boiling | A-2 | 3.0 | 12.0 | (D-1) 41.0 | (E-1) 44.0 |
| 8 | wet fine particles of cellulose | 0.03 μm | viscose rayon | A-2 + C-2 | 0.08 | 3.0 | (D-1) 36.0 | (E-1) 60.9 |
| 9 | wet fine particles of cellulose | 0.1 μm | cupra | A-1 + C-3 | 0.15 | 4.0 | (D-1) 45.8 | (E-3) 50.0 |
| 10 | wet fine particles of cellulose | 15.0 μm | extremely fine cupra | C-2 | 7.0 | 16.0 | (D-1) 45.0 | (E-1) 32.0 |

TABLE 1-2

| Example No. | Evaluation Results of Stability(1) (cps) Just after Preparation | 7 days | 15 days | 30 days | 45 days | Synthetic(3) Evaluation | Remarks |
|---|---|---|---|---|---|---|---|
| 1 | 1550 | 1600/1600/1600 | 1600/1620/1650 | 1750/1790/1790 | 1820/1750/1800 | ◎ | — |
| 2 | 900 | 1780/1630/1550 | 1750/1800/1650 | 1710/1750/1780 | 1780/1850/1830 | ○ | — |
| Com. Ex. 1 | 3000 | 2950/2920/3110 | 2800/2820/4400 | 2550/2600/5830 | 2000/2450/7120 | X | — |
| Com. Ex. 2 | 4500 | 2600/2950/(2) | 1230/3500/(2) | 600/4300/(2) | 150/(2)/(2) | XX | example demonstrating the lower limit of water content as compared with Example 2 |
| Com. Ex. 3 | 750 | 800/2320/5300 | 120/(2)/(2) | 105/(2)/(2) | 105/(2)/(2) | XX | example demonstrating that the conversion into dry powder leads to an increase in grain size, and no effect can be obtained. |
| 3 | 1200 | 1200/1180/1210 | 1170/1250/1180 | 1250/1190/1250 | 1220/1250/1210 | ◎ | best mode |
| 4 | 1150 | 1400/1390/1410 | 1370/1400/1390 | 1350/1530/1670 | 1430/1580/1650 | ○ | — |
| 5 | 800 | 2230/2180/2190 | 2310/1950/2120 | 2050/2130/2200 | 1980/2110/2050 | ○ | — |
| 6 | 1050 | 1610/1550/1580 | 1690/1750/1720 | 1880/2170/2150 | 1900/2150/2210 | ○ | — |
| 7 | 820 | 1180/1150/1230 | 1210/1350/1850 | 1880/2430/2670 | 2430/2880/3510 | Δ | deposition of powdered coal proceeds with a lapse of time |
| 8 | 450 | 740/750/730 | 780/770/810 | 780/820/880 | 810/880/930 | ○ | the viscosity per se is low because the oil content is high |
| 9 | 1100 | 1150/1200/1210 | 1360/1350/1380 | 1430/1410/1450 | 1490/1540/1530 | ◎ | — |
| 10 | 950 | 1330/1510/1830 | 1510/1680/2150 | 2050/2040/2560 | 2010/2210/2820 | ○ | — |

TABLE 2-1

| Example No. | Dispersion Stabilizer (Water-Insoluble Fine Particles having Colloid-Forming Ability) Form of Fine Particle | Mean Grain Diameter (μm ) | Starting Material for Fine Particles | Finely Pulverization Conditions |
|---|---|---|---|---|
| 11 | fine particle of natural polypeptide | 3 | silk | hydrolysis in 2% $H_2SO_4$ at 100° C. for 1 hour |
| 12 | fine particle of natural polypeptide | 5 | wool (spinned wool) | hydrolysis in 2% $H_2SO_4$ at 100° C. for 1 hour |
| 13 | fine particles of synthetic polyamide | 0.05 | nylon-6 | hydrolysis in 5% HCl at 105° C. for 2.0 hours |
| 14 | fine particles of synthetic polyamide | 0.02 | nylon-6,6 | hydrolysis in 7% HCl at 80° C. for 7 hours plus mechanical grinding |
| 15 | fine particle of synthetic polyester | 0.3 | polyethylene terephthalate fiber | hydrolysis in 2.8% aqueous solution of n-propyl amine at 150° C. for 3.0 hours |
| 16 | fine particles of synthetic polyolefin | 18 | stretched film of high density polyethylene | B + C-1 |

TABLE 2-2

| Example No. | Composition (wt %) Stabilizer | Water | Coal | Oil | Evaluation Results of Stability Just after Preparation (cps) | 30 days(3) |
|---|---|---|---|---|---|---|
| 11 | 0.50 | 6.5 | (D-3) 48.0 | (E-1) 45.0 | 1230 | ○ |
| 12 | 0.50 | 6.5 | (D-3) 48.0 | (E-1) 45.0 | 1180 | ○ |
| 13 | 0.20 | 4.8 | (D-4) 50.0 | (E-1) 45.0 | 1530 | ○ |

TABLE 2-2-continued

| Example No. | Composition (wt %) Stabilizer | Water | Coal | Oil | Evaluation Results of Stability Just after Preparation (cps) | 30 days(3) |
|---|---|---|---|---|---|---|
| 14 | 0.20 | 4.8 | (D-4) 50.0 | (E-1) 45.0 | 1610 | ◎ |
| 15 | 0.20 | 4.8 | (D-4) 50.0 | (E-1) 45.0 | 1400 | ○ |
| 16 | 5.0 | 3.0 | (D-4) 42.0 | (E-2) 50.0 | 350 | ○ |

TABLE 3-1

| Example No. | Dispersion Stabilizer (Water-Insoluble Fine Particles having Colloid-Forming Ability) Form of Fine Particles | Mean Grain Diameter (μm) | Composition (wt %) Stabilizer | Water | Coal | Oil |
|---|---|---|---|---|---|---|
| 17 | ethyl cellulose latex | 0.25 | pure content 0.3 | 4.1 | (D-1) 45.1 | (E-1) 50.5 |
| 18 | propyl cellulose latex | 0.70 | pure content 0.7 | 6.2 | (D-1) 45.1 | (E-1) 48.0 |
| 19 | natural rubber latex | 0.1 | pure content 0.3 | 4.1 | (D-1) 45.1 | (E-1) 50.5 |
| 20 | polyvinilidene chloride latex | 0.3 | pure content | 4.1 | (D-2) | (E-4) |

TABLE 3-1-continued

| Example No. | Dispersion Stabilizer (Water-Insoluble Fine Particles having Colloid-Forming Ability) Form of Fine Particles | Mean Grain Diameter (μm) | Composition (wt %) Stabilizer | Water | Coal | Oil |
|---|---|---|---|---|---|---|
| | | | 0.3 | | 45.1 | 50.5 |
| 21 | polystyrene butadiene latex | 0.2 | pure content | 4.1 | (D-1) | (E-5) |
| | | | 0.3 | | 45.1 | 50.5 |
| 22 | polyvinyl acetate latex | 1.0 | pure content | 6.2 | (D-1) | (E-2) |
| | | | 0.7 | | 45.1 | 48.0 |
| 23 | super-finely pulverized silica ($SiO_2$)*1 | 0.007 | 0.08 | 4.0 | (D-2) | (E-2) |
| | | | | | 50.8 | 45.1 |
| 24 | super finely pulverized silica ($SiO_2$)*2 | 0.05 | pure content | 5.0 | (D-3) | (E-1) |
| | | | 0.5 | | 48.0 | 46.5 |
| 25 | aluminum hydroxide colloid ($Al(OH)_3$)*3 | 0.7 | pure content | 8.0 | (D-1) | (E-1) |
| | | | 1.0 | | 45.5 | 45.5 |
| 26 | iron hydroxide colloid ($Fe(OH)_3$)*4 | 0.4 | pure content | 8.0 | (D-1) | (E-1) |
| | | | 1.0 | | 45.5 | 45.5 |
| 27 | titanium hydroxide sol $TiO_2$*5 | 4.0 | pure content | 12.0 | (D-1) | (E-1) |
| | | | 3.0 | | 40.8 | 44.2 |
| 28 | colloid graphite*6 | 0.3 | pure content | 8.0 | (D-1) | (E-1) |
| | | | 1.0 | | 45.5 | 45.5 |

*1Aerosil 300 (trade name, produced by Japan Aerosil Co., Ltd.)
*2Silica Sol "Snowtex" (trade name, produced by Nissan Chemical Industries Co., Ltd.)
*3prepared by adding $Al_2(SO_4)_3$ aq. at 98° C. for 84 hours
*4prepared by adding $NH_4OH$ water to $FeCl_3$
*5prepared by adding $Na_2SO_4$ to $TiCl_4$ aq. and aging the mixture at 98° C. for 41 hours
*6prepared by adding a dispersion stabilizer to graphite powder, grinding the mixture in a ball mill, and centrifugally separating

TABLE 3-2

| Example No. | Evaluation Results of Statis Stability: Just after Preparation (cps) | 30 days(3) |
|---|---|---|
| 17 | 1210 | ○ |
| 18 | 1330 | ◎ |
| 19 | 1630 | Δ |
| 20 | 1550 | ○ |
| 21 | 1600 | Δ |
| 22 | 1280 | ○ |

TABLE 3-2-continued

| Example No. | Evaluation Results of Statis Stability: Just after Preparation (cps) | 30 days(3) |
|---|---|---|
| 23 | 1050 | ○ |
| 24 | 510 | ◎ |
| 25 | 950 | ○ |
| 26 | 970 | Δ |
| 27 | 830 | ◎ |
| 28 | 800 | ○ |

TABLE 4-1

| Example No. | Dispersion Stabilizer (Water-Insoluble Fine Particles having Colloid-Forming Ability) Form of Fine Particles | Mean Grain Diameter (μm) | Composition (wt %) Stabilizer | Water | Coal | Oil |
|---|---|---|---|---|---|---|
| 29 | wet cake of fine crystalline cellulose | 1.5 | 0.5 | 5.0 | (D-1) | (E-1) |
| | | | | | 47.0 | 47.5 |
| 30 | wet cake of fine crystalline cellulose | " | 0.3 | 4.7 | (D-1) | (E-1) |
| | | | | | 53.0 | 42.0 |
| 31 | wet cake of fine crystalline cellulose | " | 0.2 | 3.8 | (D-1) | (E-1) |
| | | | | | 42.0 | 54.0 |
| 32 | wet cake of fine crystalline cellulose | " | 1.8 | 9.0 | (D-1) | (E-1) |
| | | | | | 48.2 | 41.0 |
| 33 | wet cake of fine crystalline cellulose | " | 0.2 | 1.5 | (D-1) | (E-1) |
| | | | | | 43.8 | 54.5 |
| Com. Ex. 4 | wet cake of fine crystalline cellulose | " | 1.0 | 0.3 | (D-1) | (E-1) |
| | | | | | 54.0 | 44.7 |
| 34 | wet cake of fine crystalline cellulose | " | 0.5 | 7.5 | (D-1) | (E-1) |
| | | | | | 60.0 | 32.0 |
| 35 | wet cake of fine crystalline cellulose | " | 0.5 | 7.5 | (D-1) | (E-1) |
| | | | | | 67.0 | 25.0 |
| Com. Ex. 5 | wet cake of fine crystalline cellulose | " | 0.5 | 7.5 | (D-1) | (E-1) |
| | | | | | 75.0 | 18.0 |
| 36 | wet cake of fine crystalline cellulose | " | 0.08 | 13.92 | (D-1) | (E-1) |
| | | | | | 48.0 | 38.0 |
| 37 | wet cake of fine crystalline cellulose | " | 4.0 | 18.0 | (D-1) | (E-1) |
| | | | | | 52.0 | 26.0 |
| Com. Ex. 6 | wet cake of fine crystalline cellulose | " | 7.0 | 22.0 | (D-1) | (E-1) |
| | | | | | 55.0 | 16.0 |
| 38 | wet cake of fine crystalline cellulose | " | 2.0 | 15.0 | (D-1) | (E-1) |
| | | | | | 39.0 | 44.0 |
| 39 | wet cake of fine crystalline cellulose | " | 8.0 | 18.0 | (D-1) | (E-1) |
| | | | | | 35.0 | 39.0 |
| Com. Ex. 7 | wet cake of fine crystalline cellulose | " | 9.0 | 27.0 | (D-1) | (E-1) |
| | | | | | 31.0 | 33.0 |
| 40 | wet cake of fine crystalline cellulose | " | 1.0 | 8.0 | (D-1) | (E-1) |
| | | | | | 37.0 | 54.0 |

TABLE 4-1-continued

| Example No. | Dispersion Stabilizer (Water-Insoluble Fine Particles having Colloid-Forming Ability) Form of Fine Particles | Mean Grain Diameter (μm) | Composition (wt %) Stabilizer | Water | Coal | Oil |
|---|---|---|---|---|---|---|
| Com. Ex. 8 | wet cake of fine crystalline cellulose | " | 0.2 | 8.8 | (D-3) 19.0 | (E-4) 72.0 |

TABLE 4-2

| Example No. | Evaluation Results of Stability Just after Preparation (cps) | 30 days(3) | Remarks |
|---|---|---|---|
| 29 | 1120 | ◎ | — |
| 30 | 1210 | ○ | — |
| 31 | 950 | ◎ | — |
| 32 | 1050 | ◎ | — |
| 33 | 1100 | ○ | — |
| Com. Ex. 4 | 1930 | XX | Water content is outside the range as specified in the invention. |
| 34 | 2520 | ○ | — |
| 35 | 3510 | Δ | — |
| Com. Ex. 5 | no fluidity | XX | — |
| 36 | 1520 | ○ | — |
| 37 | 1750 | Δ | — |
| Com. Ex. 6 | oil-water separation | XX | — |
| 38 | 620 | ○ | — |
| 39 | 530 | Δ | Since the water content is high, the oil-water separation gradually occurs and slight deposition of coal is observed. |
| Com. Ex. 7 | oil-water separation | XX | — |
| 40 | 730 | ◎ | — |
| Com. Ex. 8 | 280 | ◎ | Although the stability is good, the coal content is low and the economical value is low. |

TABLE 5-1

| Example No. | Dispersion Stabilizer (Water-Insoluble Fine Particles having Colloid-Forming Ability) Form of Fine Particle | Mean Grain Diameter | Starting Material for Fine Particles | Fine Pulverization Conditions | Composition (wt %) Stabilizer | Water | Coal | Oil |
|---|---|---|---|---|---|---|---|---|
| 41 | wet cake of fine crystalline cellulose | 0.5 μm | alkali cellulose formed by alkali treatment of purified linter | A-2 + C-1 | 0.5 | 5.5 | 47.0 | 47.0 |
| 42 | wet of fine crystalline cellulose | 0.9 μm | alkali cellulose formed by alkali treatment of purified linter | A-1 | " | " | " | " |
| 43 | wet of fine crystalline cellulose | 1.5 μm | sulfate wood pulp | A-1 + C-1 | " | " | " | " |
| 44 | wet of fine crystalline cellulose | 4.0 μm | purified linter | A-2 | " | " | " | " |
| 45 | wet of fine crystalline cellulose | 9.0 μm | sulfate wood pulp | A-1 | " | " | " | " |
| 46 | wet cake of fine crystalline cellulose | 14.0 μm | cupra | C-2 | " | " | " | " |
| 47 | wet cake of fine crystalline cellulose | 18.0 μm | crude linter | A-2 | " | " | " | " |
| Com. Ex. 9 | dry powder of fine crystalline cellulose | 25.0 μm | purified linter | A-2 + drying by spray drier followed by scieving | " | " | " | " |
| Com. Ex. 10 | dry powder of fine crystalline cellulose | 40.0 μm | sulfate wood pulp | A-1 + drying by spray drier | " | " | " | " |

TABLE 5-2

| Example No. | Evaluation Results of Stability(1) (cps) Just after Preparation | 7 days | 15 days | 45 days | Synthetic(3) Evaluation |
|---|---|---|---|---|---|
| 41 | 1050 | — | — | 1180/1250/1210 | ◎ |
| 42 | 1090 | — | — | 1170/1300/1350 | ◎ |
| 43 | 1170 | — | — | 1350/1570/1680 | ○ |
| 44 | 1000 | — | — | 1430/1630/1590 | ○ |
| 45 | 1010 | — | — | 1250/2400/2730 | Δ |
| 46 | 1020 | — | — | 910/2700/3650 | Δ |
| 47 | 1150 | — | — | 750/2620/4210 | Δ |
| Com. Ex. 9 | 980 | 630/3530/5810 | 250/(2)/(2) | — | X |
| Com. Ex. 10 | 1010 | 110/(2)/(2) | — | — | XX |

While the invention has been described in detail and with reference to specific embodiment thereof, it will be apparent to one skilled in the art that various changes and modifications can be made therein without departing from the spirit and scope thereof.

What is claimed is:

1. A thixotropic mixed fuel comprising coal, oil, water and a dispersion stabilizer wherein said coal is a powdered coal which can all pass through a 100-mesh screen, and said dispersion stabilizer is a water-insoluble fine particle having a colloid-forming ability, having a mean grain diameter of 20 μm or less, that is selected from the group consisting of (1) a water-insoluble natural polymeric compound and (2) a water-insoluble polymeric compound prepared by a chemical treatment or dissolution and regeneration of a natural polymeric compound.

2. The mixed fuel as claimed in claim 1, wherein the water-insoluble natural polymeric compound is a natural cellulose.

3. The mixed fuel as claimed in claim 2, wherein the natural cellulose is a member selected from the group consisting of celluloses such as pulp, cotton, and flax, and polypeptides such as silk and wool.

4. The mixed fuel as claimed in claim 1, wherein the water-insoluble polymeric compound prepared by a chemical treatment or dissolution and regeneration of a natural polymeric compound having a fiber-forming ability is a member selected from the group consisting of viscose rayon, cupra and alkali cellulose.

5. The mixed fuel as claimed in claim 1, wherein the mean grain diameter of the water-insoluble fine particle having a colloid-forming ability is from 0.005 μm to 10 μm.

6. The mixed fuel as claimed in claim 5, wherein the mean grain diameter of the water-insoluble fine particle having a colloid-forming ability is from 0.05 μm to 2 μm.

7. The mixed fuel as claimed in claim 2, wherein the water-insoluble fine particle having a colloid-forming ability is a fine particle prepared by chemical pulverization of a fibrous substance or a natural cellulose having a fiber-forming ability.

8. The mixed fuel as claimed in claim 1, wherein the water-insoluble fine particle having a colloid-forming ability is a fine particle prepared by chemical pulverization of a water-insoluble polymeric compound which is prepared by a chemical treatment or dissolution and regeneration of a fibrous substance or a natural polymeric compound having a fiber-forming ability.

9. The mixed fuel as claimed in claim 7 or 8, wherein the chemical pulverization of polymeric compounds is achieved by a decomposition reaction using a mineral acid, an alkali or a peroxide.

10. The mixed fuel as claimed in claim 9, wherein the mineral acid is diluted hydrochloric acid.

11. The mixed fuel as claimed in claim 1, wherein the oil is a heavy oil or a crude oil.

12. The mixed fuel as claimed in claim 1, wherein the coal is a member selected from the group consisting of anthracite, bituminous coal, and brown coal.

13. The mixed fuel as claimed in claim 1, wherein the coal is a powdered coal which all can pass through a 100-mesh screen, a 60 to 90% portion of which can pass through a 200-mesh screen.

14. The mixed fuel as claimed in claim 1, comprising from 69.9 to 30.0% of coal and from 21.0 to 65.0% of oil, the balance being water and a dispersion stabilizer, wherein the water content is from 0.5 to 20% and the dispersion stabilizer content is from 0.05 to 10%.

15. The mixed fuel as claimed in claim 1, comprising from 40 to 55% of coal and from 55 to 40% of oil, the balance being water and a dispersion stabilizer, wherein the water content is from 2.0 to 10% and the dispersion stabilizer content is from 0.1 to 2%.

16. The mixed fuel as claimed in claim 1, comprising from 40 to 55 parts by weight of powdered coal having a grain size distribution that all can pass through a 100-mesh screen and a 60 to 90% portion can pass through a 200-mesh screen, from 55 to 40 parts by weight of heavy oil, and from 3.0 to 7.0 parts by weight of water, the balance being a dispersion stabilizer, wherein the dispersion stabilizer is a fine particle having a mean grain diameter of from 0.5 to 1.5 μm which is prepared by hydrolyzing a linter cellulose with a mineral acid after an alkali treatment thereof and, thereafter, chemically pulverizing the hydrolyzate.

17. The mixed fuel as claimed in claim 1, wherein said dispersion stabilizer is selected from the group consisting of a natural cellulose, viscose rayon, cupra and alkali cellulose.

* * * * *